United States Patent [19]

Lerch et al.

[11] Patent Number: 4,606,507

[45] Date of Patent: Aug. 19, 1986

[54] SPOOLING DEVICE FOR SEWING MACHINES

[75] Inventors: Hans-Ulrich Lerch; Willi Oberholzer, both of Steckborn, Switzerland

[73] Assignee: Fritz Gegauf Aktiengesellschaft Bernina-Nähmaschinenfabrik, Steckborn, Switzerland

[21] Appl. No.: 695,292

[22] Filed: Jan. 28, 1985

[30] Foreign Application Priority Data

Feb. 8, 1984 [CH] Switzerland ..... 581/84

[51] Int. Cl.[4] ..... B65H 63/08; D05B 59/00

[52] U.S. Cl. ..... 242/22; 242/39; 242/49; 112/279

[58] Field of Search ..... 112/279; 242/22, 49, 242/39

[56] References Cited

U.S. PATENT DOCUMENTS

| | | | |
|---|---|---|---|
| 935,263 | 9/1909 | Chapelle | 242/22 |
| 2,255,152 | 9/1941 | Colegrove | 242/22 |
| 4,096,812 | 6/1978 | Gegauf | 112/279 |
| 4,259,914 | 4/1981 | Johnson | 112/279 |

FOREIGN PATENT DOCUMENTS

| | | | |
|---|---|---|---|
| 888057 | 1/1962 | United Kingdom | 112/279 |

OTHER PUBLICATIONS

Russian document #587184; Jan. 3, 1978, shts. drawings:2; pp. spec. 2.

*Primary Examiner*—Werner H. Schroeder
*Assistant Examiner*—Joseph S. Machuga
*Attorney, Agent, or Firm*—Birch, Stewart, Kolasch & Birch

[57] ABSTRACT

The winder shaft for a sewing machine, fashioned as a support for a thread bobbin, is positioned directly on the shaft of a low-voltage motor, independent of the drive motor for the sewing mechanism of the sewing machine. An on/off switch for this motor is operable by means of a three-armed switching lever, with the first arm being adapted to scan the package of wound thread forming on the bobbin. A trigger cam disposed on the third arm slides, during this operation, over a first surface of a spring-biased dual ramp. Once the thread bobbin is full, the trigger cam surpasses the apex of the dual ramp, and the switching lever flips into a disconnect position and cuts off the motor by way of a switching cam disposed on the second arm. All of the elements of the spooling device are mounted to a common support so that the spooling device, which is independent of the drive mechanism of the sewing machine, can be attached as a composite unit at any desired location on the sewing machine.

4 Claims, 7 Drawing Figures

SPOOLING DEVICE FOR SEWING MACHINES

BACKGROUND AND SUMMARY OF THE INVENTION

The present invention relates to a spooling device for sewing machines.

In spooling devices of conventional construction, the thread bobbin to be wound with thread can be placed on a winder shaft, and the winder shaft can be driven by the drive motor of the sewing mechanism for the sewing machine. Thus, arrangements are known wherein the spooling device is disposed on the shaft of the drive motor, with clutch means being provided for selectively coupling the motor shaft to the sewing mechanism or to the spooling device. The disadvantages in this construction reside in the fact that the spooling device is not in the field of vision of the operator; the feeding of the thread during spooling requires additional thread guide means; the winder shaft must be electrically insulated from the motor shaft; and the simultaneous steps of sewing and spooling is impossible.

Spooling devices have also become known, for example according to Swiss Patent No. 567,602 wherein the winder shaft is arranged in the region of the handwheel, drivable by the arm shaft of the sewing machine. The winder shaft can be placed in driving engagement with the handwheel by means of a displaceable friction wheel. Although this type of structure provides considerable advantages as compared with the first-mentioned arrangement, it is still deficient inasmuch as it requires, by necessity, the arrangement of the spooling device in the zone of the handwheel. Also, the friction-wheel drive is noisy in most cases and, on account of the unavoidable friction wheel abrasion, leads to an undesired contamination of the sewing machine.

In contrast to the above, the present invention has the purpose of providing a spooling device that can be located and/or operated locally and independently of the drive elements of the sewing mechanism, and can function without complicated or greatly wear-prone coupling means.

To achieve this object, the spooling device of the present invention is characterized in that its winder shaft is seated on the output shaft of a low-voltage motor associated with a switch, said switch being operated by means of a switching element responsive to the winding process.

The low-voltage motor, independent of the drive motor of the sewing mechanism includes, a winder shaft seated directly on its output shaft and serving for receiving the thread bobbin, makes it possible to arrange the spooling device practically at any suitable location of the sewing machine so that it can be optimally operated, provides a maximally simple thread feed, and can be activated while the sewing mechanism is in operation as well as while the sewing mechanism is at a standstill.

Suitably, the low-voltage motor with the winder shaft, the trigger element, and the switch is disposed on a support permitting various mounting possibilities at the machine housing, so that the preassembled spooling device can be mounted as a module in various positions, for example with a winder shaft that projects upwardly toward the handwheel side or forwardly out of the machine housing. An arrangement at the head of the machine can also be advantageous so that direct thread feed is possible from the needle to the bobbin on the winder shaft.

In case of electronic sewing machines, the arrangement of the spooling device directly beside the feed dog of the machine would also be possible. The spooling device could, in this case, be located underneath the same cover plate which is merely somewhat wider. The thread guided through the needle underneath the needle plate could then be directly guided to the bobbin and wound up.

The switching element is suitably a three-armed lever, pivotable in an axial plane through the winder shaft, the first arm being constructed for scanning the wound-up thread package, the second arm for operating the switch, and the third arm, in cooperation with an incline, for triggering the switchover step. Suitably, the feeler arm, which projects as is usual into the region of the bobbin out of the machine housing, serves simultaenously as a manually operable switch-on element.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
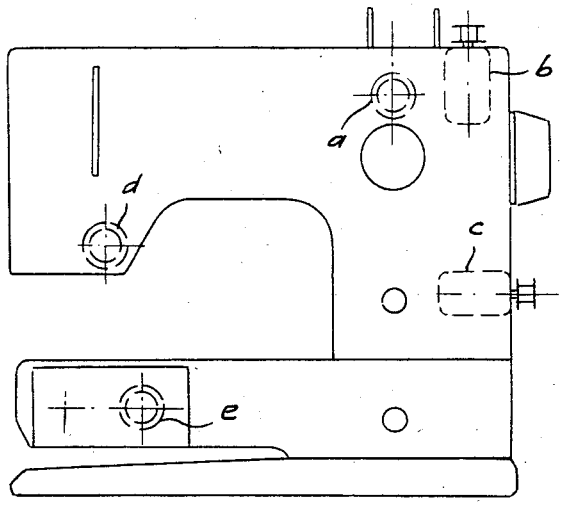
FIG. 1 shows a side view of a sewing machine, illustrating various locations for mounting the spooling device.
Figure 5:
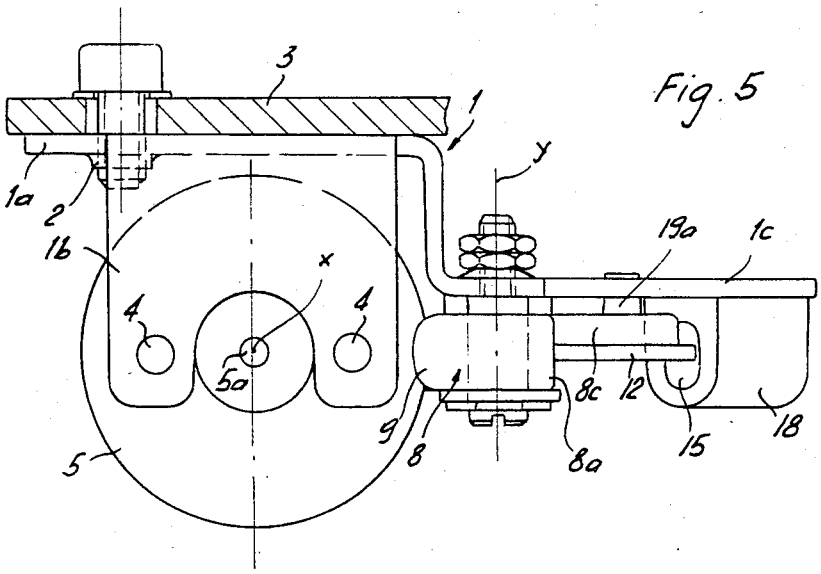
FIG. 5 shows a top view of FIG. 3.
Figure 6:
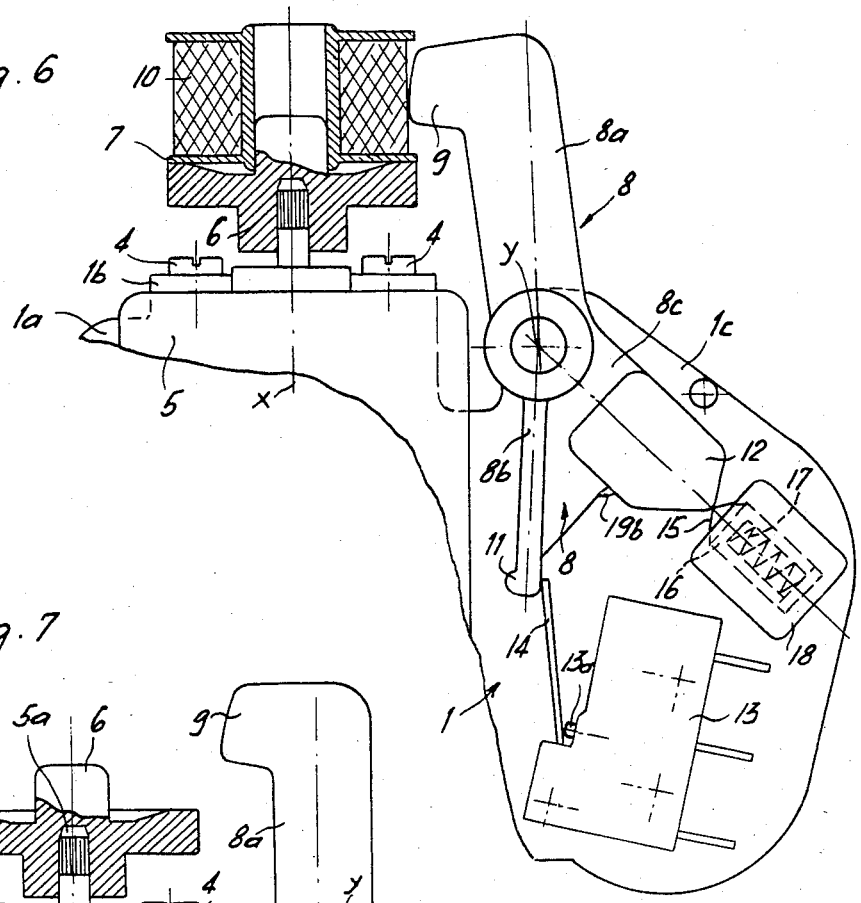
FIG. 6 shows a view analogous to FIG. 2, illustrating the switching element at the switchover point.
Figure 7:
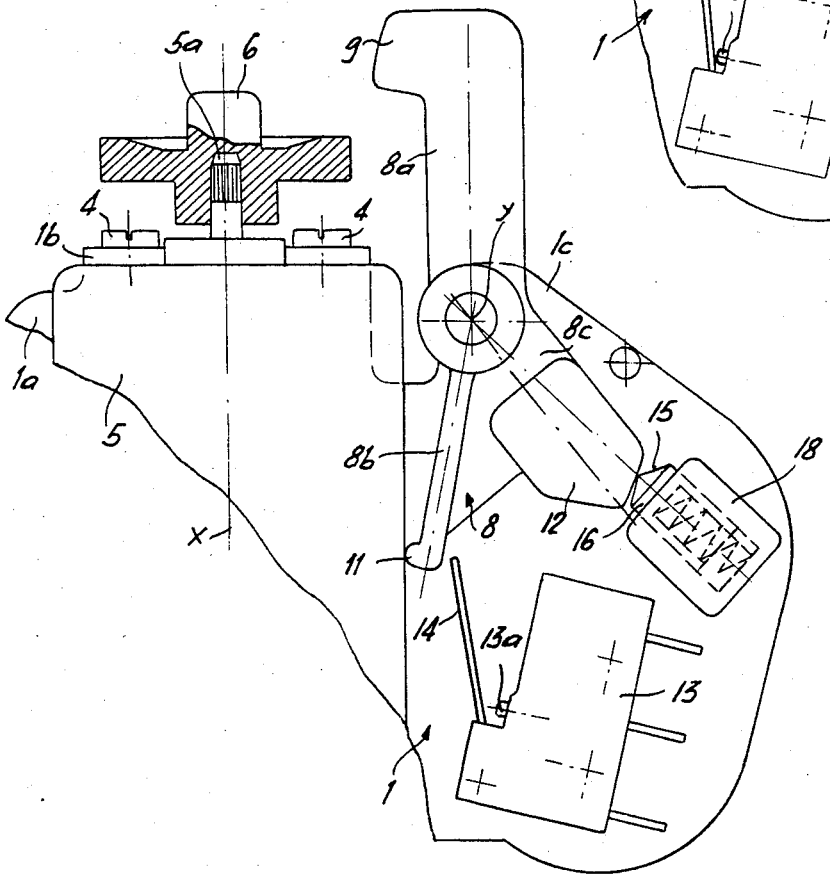
FIG. 7 shows a view analogous to FIG. 2, illustrating the switching element in the cut-off position.

FIG. 1 shows a household sewing machine with various possibilities, schematically indicated at a, b, c, d, and e, for arranging the spooling device of the present invention, as illustrated by way of example in the other figures. This spooling device, constituting a structural unit, comprises an elbow-shaped support 1, one leg 1*a* of the support serving, as indicated at 2 in FIGS. 2 and 5, for mounting the spooling device, for example by means of screws, to the housing 3 of the sewing machine. As indicated at 4 in FIGS. 2 and 5, a low-voltage motor 5 is attached to a cover flange 1*b* of this support 1. The shaft 5*a* of the low-voltage motor projects through a cutout in the cover flange 1*b*. The winder shaft 6, fashioned as a bobbin carrier and adapted to have the bobbin 7 (FIGS. 2, 6, 7), to be wound with thread, placed thereon, is seated on the motor shaft 5*a* for rotation therewith.

A three-armed switching lever 8, pivotable in the plane through the motor axis, is mounted to the other support leg 1*c* about an axis y perpendicular to the motor axis x. The first lever arm 8*a*, extending through a housing aperture toward the outside into the zone of the thread bobbin 7 disposed on the winder shaft 6, is provided with a feeler cam 9 that serves in the switched-on position of the switching lever 8 for scanning the package 10 of thread being formed during the winding process. The second arm 8*b* of the switching lever 8 is provided at its free end with a switching cam 11, and the third lever arm 8*c* is provided with a trigger cam 12 angularly offset with respect to the switching cam 11 in the pivoting plane of the switching lever 8. The switching cam 11 cooperates with one end of a switching lug 14 operating the on-off switch 13 of the low-voltage motor 5 affixed to the support leg 1*c*, while the trigger cam 12 cooperates with a wedge-shaped dual incline 15. The dual incline 15 is formed at the free end of a pin 16. The pin 16 is radially positioned with respect to the pivoting axis y of the switching lever 8. This pin, stressed axially by a spring 17, is guided with limited movability in a bushing 18 attached to support leg 1*c*. The trigger cam 12 is illustrated as a separate part affixed to the lever arm 8*c*, but it could also be integral with the lever arm. A pivot 19*a* is arranged at the lever arm 8*c* and is guided in an arcuate groove 19*b* of the support leg 1*c*, thus restricting the possible pivotal range of the switching lever 8.

Figure 2:
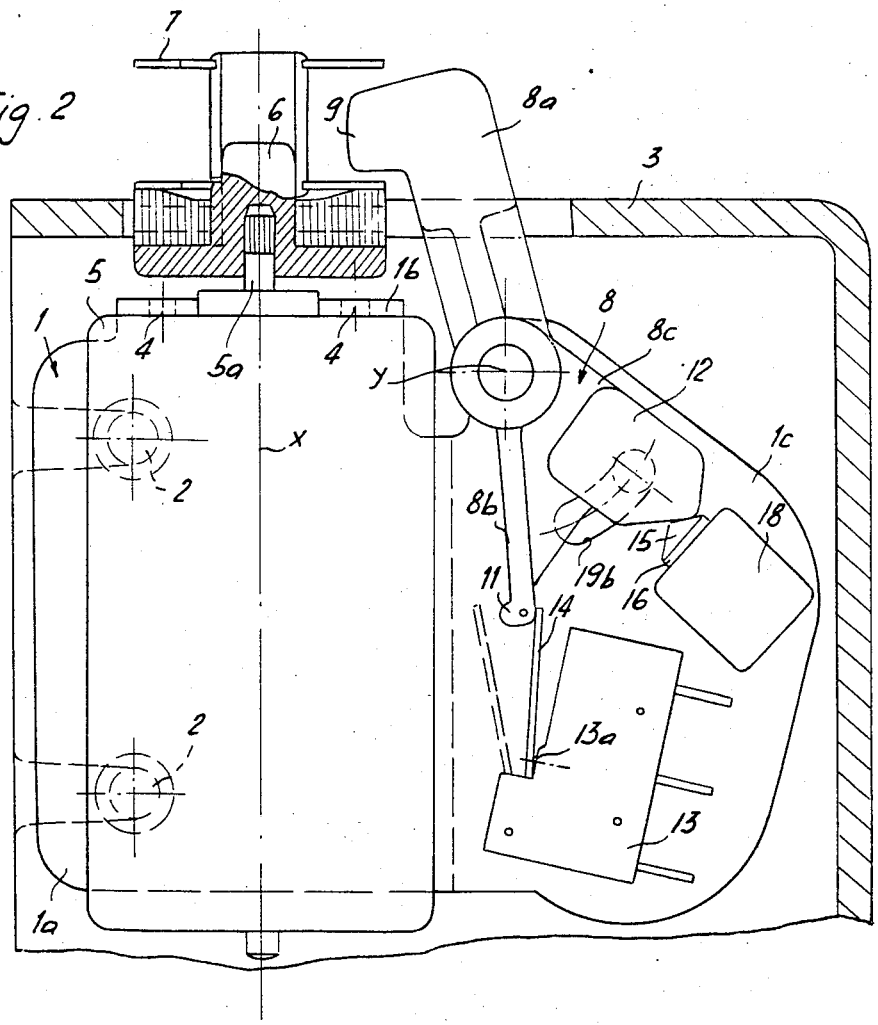
FIG. 2 shows, on an enlarged scale and in lateral view, one example for a spooling device in the turned-on position with the bobbin in place.
Figure 3:
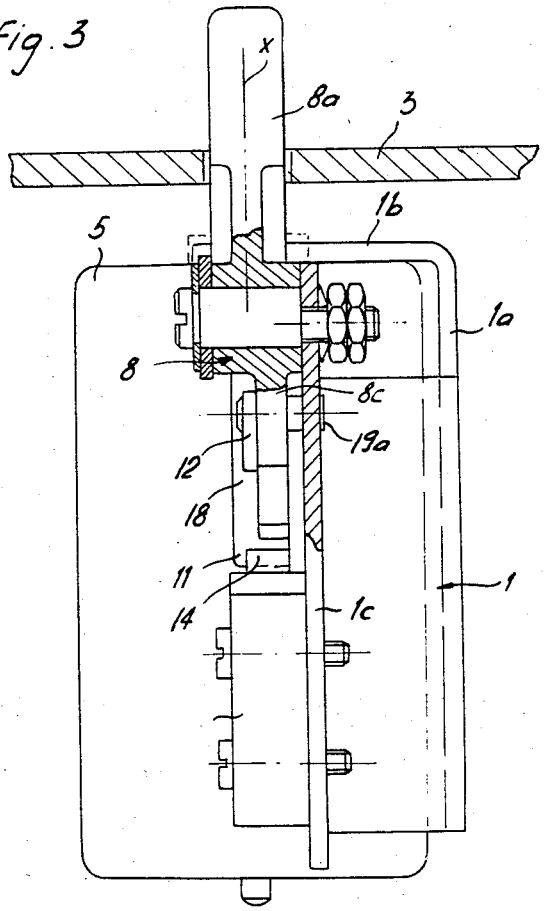
FIG. 3 shows in a frontal view, partially in section, the spooling device according to FIG. 2.
Figure 4:
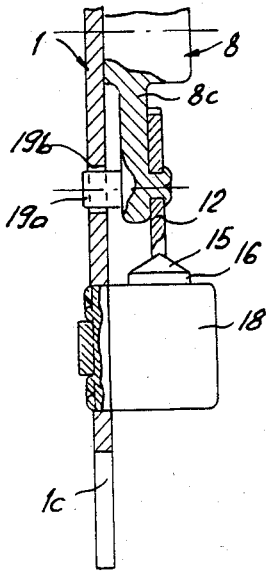
FIG. 4 shows a view in the direction of arrow P in FIG. 2, partially in section.

The mode of operation of the above-described spooling device is as follows:

FIG. 2 shows the switching lever in its operative position, into which it can be placed, for example by a manual turning of the lever arm 8*a* (in the counterclockwise direction in FIG. 2) or by means of a rotatable handle engaging the switching lever hub. In this operative position, the feeler cam 9 of the lever arm 8*a* projects into the winding area of the empty thread bobbin 7 placed on the winder shaft 6, which latter serves as an entrainment means, while the switching cam 11 of the lever arm 8*b*, via the switching lug 14, maintains the switching pin of the switch 13, indicated at 13*a*, in the turned-on position. The motor 5 which accordingly is running can thus effect the spooling of the thread (not shown) fed onto the bobbin 7. As can be seen from FIG. 2, in this operating position, the trigger cam 12 of the lever arm 8*c* rests on the incline surface of the double ramp 15 of the spring-biased pin 16 that faces away from the switching cam 11. Once the circumference of the thread package 10, growing in diameter during the spooling process, has reached the feeler cam 9, a further increase in the diameter of the thread package 10 effects a corresponding pivoting of the switching lever 8 about its axis y in the clockwise direction. The correspondingly turning trigger cam 12 slides, during this step, over the incline surface toward the apex of the dual ramp 15 and simultaneously urges the pin 16, against the action of the spring 17, inwardly within the bushing 18. When the trigger cam 12 during this pivotal motion of the switching lever 8 caused by the increasing thread package 10, reaches the apex of the dual ramp 15 (FIG. 6), the thread package 10 has reached the desired size. Any further growing of the package immediately causes a sliding down of the trigger cam 12 along the incline surface of the dual ramp 15 lying closer to the switching cam 11 into the position shown in FIG. 7, due to the unstable position of the trigger cam 12 on the apex of the dual ramp 15 and the pressure action of the spring 17. This results in a corresponding pivoting of the switching lever 8 in the clockwise direction and into a cut-off position, whereby the feeler cam 9 is lifted off the thread package 10 while the switching lug 14, fashioned as a leaf spring, follows the correspondingly yielding switching cam 11 and thus releases the switching pin 13*a* of the switch 13, said pin being spring-biased for creating a disconnect operation. Thereby the motor 5 is disconnected and the wound thread package 10 can be taken off the winder shaft 6. As mentioned above, the cut-off pivoting step of the switching lever 8 is limited by the pivot 19*a* abutting against the end of the arcuate groove 19*b*.

It can be seen from the above, the spooling device can be mounted as a module at any location of the sewing machine, in the machine housing which appears suitable for this purpose and offers adequate space. In particular, the spooling device can also be arranged where a minimum of thread guidance effort is required, for example, for feeding the upper thread. The described spooling device is entirely independent of the drive motor for the sewing mechanism of the machine and consequently can be placed in operation at any time. Thus complicated and wear-prone coupling means are eliminated by the direct connection of the winder shaft, fashioned as the bobbin carrier, with the shaft of the low-voltage motor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spooling device for a sewing machine, said spooling device having associated therewith a bobbin operatively connected to a low-voltage motor which comprises:

a winder shaft for winding thread on the bobbin and driven to be turned on and off, said winder shaft being mounted on the output shaft of the low-voltage motor, a switch operably associated with the low-voltage motor, and a switching element operably associated with and responsive to the winding process whereby when the bobbin is wound to a predetermined extent, the switching element operates the switch to disengage the low-voltage motor, said switching element comprises a three armed lever pivotable in the axial plane of the winder shaft, a first arm extending in the vicinity of the bobbin and provided with a feeler cam for scanning the extent of the thread being formed on the bobbin, a second arm provided with a switching cam for operating an on/off switch of the low-voltage motor, and a third arm provided with a trigger cam which cooperates with a spring-biased wedge-shaped dual ramp for initiating the switch-off operation of the switch when the bobbin is fully wound.

2. The spooling device of claim 1 wherein the sewing machine is provided with a housing, a support plate is attached to the housing, and the spooling device is arbitrarily mounted in the housing as a unit.

3. The spooling device of claim 1, wherein the dual ramp is provided at its end face with a pin which is radially disposed with respect to the pivot axis of the switching element and a spring is provided for spring-biasing said switching element toward said axis, wherein the trigger cam, being responsive to the scanning by the feeler cam of said first arm, traverses a first incline surface of the dual ramp and, when the bobbin is fully wound, reaches the apex of the dual ramp, which in cooperation with the switching cam and a second incline surface of the dual ramp causes a tipping of the switching element into switch-off position.

4. The spooling device according to claim 3, wherein said pin is mounted within a bushing for limiting the movement of said pin and further including a spring positioned within said bushing for biasing said pin toward said trigger cam.

* * * * *